US005568734A

United States Patent [19]

Niemerg et al.

[11] Patent Number: 5,568,734

[45] Date of Patent: Oct. 29, 1996

[54] DOUBLE LAYER COOLER

[75] Inventors: Hermann Niemerg, Ennigerloh; Ralf Osburg, Beckum; Arthur Berger, Ennigerloh; Bernd Nienaber, Ahlen; Manfred Strohbusch, Ennigerloh, all of Germany

[73] Assignee: Krupp Polysius AG, Beckum, Germany

[21] Appl. No.: 444,569

[22] Filed: May 19, 1995

[30] Foreign Application Priority Data

Jun. 6, 1994 [DE] Germany ..... 44 19 728.4

[51] Int. Cl.[6] ..... F25D 25/00

[52] U.S. Cl. ..... 62/378; 62/57; 62/63

[58] Field of Search ..... 62/57, 63, 378

[56] References Cited

U.S. PATENT DOCUMENTS 2,506,317 5/1950 Rex ..... 62/57

FOREIGN PATENT DOCUMENTS 1097346 1/1961 Germany .

*Primary Examiner*—Ronald C. Capossela

*Attorney, Agent, or Firm*—Learman & McCulloch

[57] ABSTRACT

Bulk material cooling comprises includes a conveyor having a support surface for transporting bulk material from the conveyor inlet to its outlet. A first material supply chute is provided at the inlet for depositing a quantity of relatively cool material on the conveyor. A baffle is located downstream of the supply chute for leveling the material on the conveyor and forming a uniform thickness layer of such material. A second material supply chute is arranged downstream of the baffle for depositing a layer of relatively hot material atop the first layer. The first layer of material protects the conveyor from the heat of the second layer. Cooling air is passed upwardly through the first and second layer to cool the material.

10 Claims, 3 Drawing Sheets

1
2
3
4
5
6
7
8
9
10
11
12
13
14
15
16
17
18
20
21
21a
22
23
24
27
28
29

DOUBLE LAYER COOLER

The invention relates to a double layer cooler in which the material for cooling is moved on a cooling surface from the start of the cooler to the end of the cooler, wherein in a first material feed zone at the start of the cooler an upper layer of hot material for cooling is fed onto a lower layer of material for cooling which has already been precooled and at the end of the cooler the two layers are separated from one another by a separating arrangement, wherein the material of the lower layer is drawn off as finished material and the material of the upper layer is returned as recirculated material to a second material feed zone at the start of the cooler by a transport arrangement and is there fed onto the cooling surface as the lower layer.

BACKGROUND OF THE INVENTION

A double layer cooler of the aforementioned generic type is known for example from DE-C-10 97 346. Such a cooler has the advantage that the cooling surface, which consists for example of grate plates and/or rows of grate plates which can be aerated individually, is protected from heat since the lower layer is already precooled and thus acts as a protective layer.

However, such a construction has the disadvantage that with fluctuating quantities of recirculated material the height of the lower layer also varies constantly. This results on the one hand in difficulties in adjusting the separating arrangement at the end of the cooler, so that in certain circumstances material which has already cooled sufficiently is returned as recirculated material and on the other hand the cooling effect varies due to the differing layer heights of the lower layer.

The object of the invention, therefore, is to construct a double layer cooler of the type mentioned in the introduction so that the efficiency of the cooler is improved.

SUMMARY OF THE INVENTION

This object is achieved according to the invention by the provision a baffle or scraper in the region between the first and second material feed zones the baffle having a lower edge spaced a predetermined distance above the conveyor surface to limit the height of the lower layer.

Thus with the construction according to the invention a uniform height of the lower layer is ensured during operation, so that on the one hand a relatively uniform cooling effect is achieved and on the other hand the separating arrangement can be set for separation of the lower and upper layers.

In a preferred embodiment the distance between the lower edge of the baffle wall and the cooling surface is adjustable, so that according to the grain size of the material to be cooled an optimum height of the lower layer can be set. Thus finer-grained material requires a thinner lower layer than does coarse-grained material.

Further advantages and embodiments of the invention are explained in greater detail below with the aid of the description of a preferred embodiment and the drawings.

THE DRAWINGS

In the drawings:

FIG. 1 shows a schematic overall view of a double layer cooler according to the invention, FIG. 2 shows a sectional view in the region of the baffle wall along the line II—II in FIG. 3, FIG. 3 shows a sectional view along the line III—III in FIG. 2 and FIG. 4 shows a sectional view along the line IV—IV in FIG. 3.

DETAILED DESCRIPTION

Figure 1:
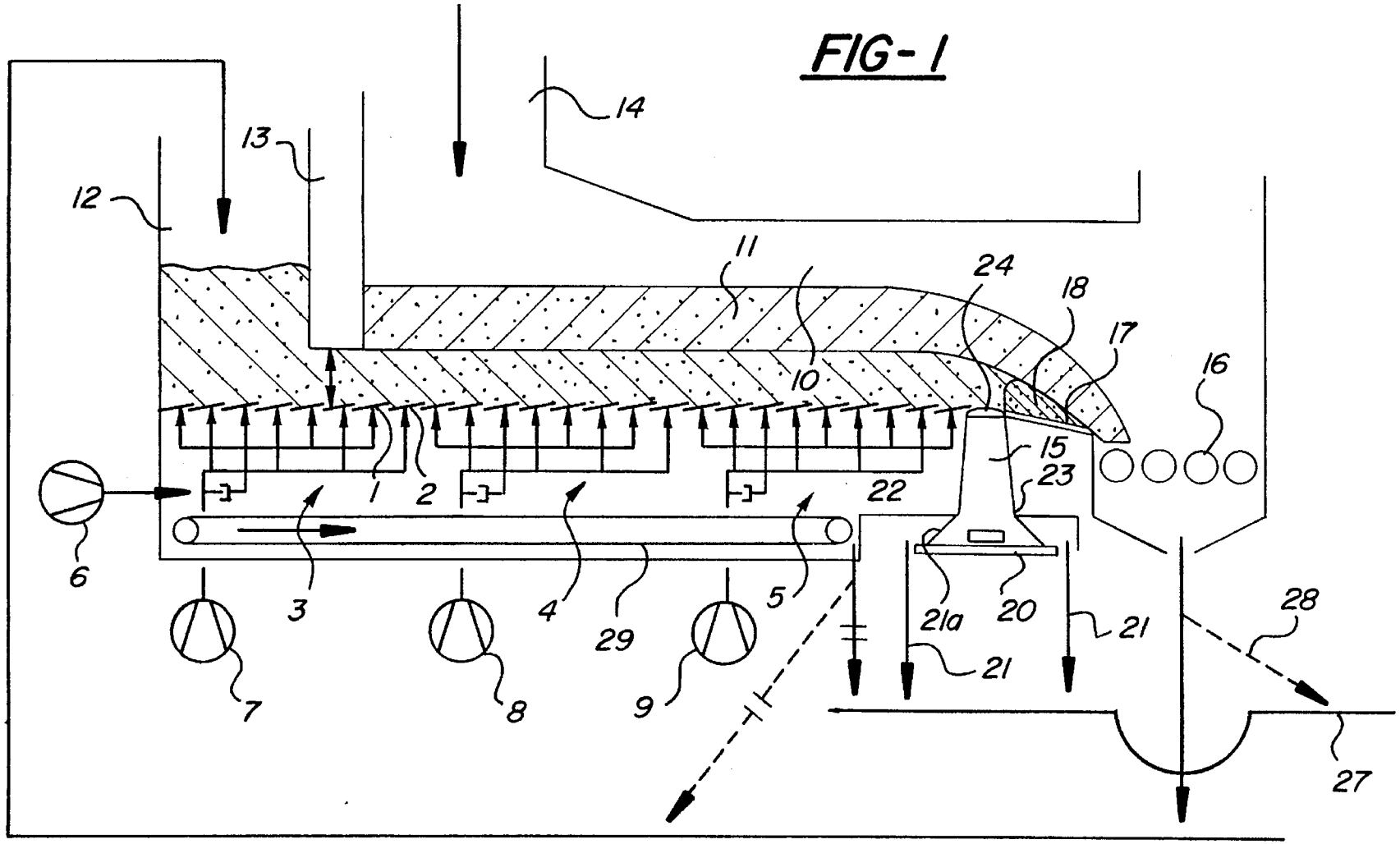

The double layer cooler shown in a schematic overall view in FIG. 1 is constructed as a reciprocating grate cooler, successive rows of plates 1, 2 being disposed so that they are alternately stationary and movable.

The rows of plates of the cooler are assembled into several groups 3, 4, 5, which are separately supplied with cooling air by way of fans 6 and 7 or 8, 9 respectively.

In a first material feed zone at the start of the cooler a lower layer 10 of material for cooling which has already been precooled is fed onto the grate surface of the cooler. An upper layer 11 of hot material for cooling is fed onto this lower layer 10. The precooled material for cooling of the lower layer 10 is delivered by way of a shaft 12 which is separated by a baffle or bunker wall 13 from a shaft 14 through which the hot material for cooling—coming for example from a rotary kiln—is fed onto the lower layer 10 of the double layer cooler.

At the end of the cooler a finished material shaft 15 is provided for drawing off the material of the lower layer 10. A crusher 16 is also disposed there, preceded by a chute 17 which delivers the material of the upper layer 11 to the crusher 16. In this case this chute 17 is inclined so flat that a resting material zone 18 forms on it. It constitutes a separating arrangement which separates the layers 10 and 11 from one another at the end of the cooler by holding back the material of the lower layer 10 and guiding it into the finished material shaft 15, whilst the material of the upper layer 11 can slide on over the resting material 18 so that it reaches the crusher 16.

Coarser parts of the material of the upper layer 11 are crushed by the crusher 16. After passing through the crusher 16 the material of the upper layer 11 passes back as recirculated material to the start of the cooler (conveying line 19) and is there fed onto the grate surface of the cooler as the lower layer 10.

The lower end of the finished material shaft 15 opens at a distance above a baffle surface 20 which is formed by a horizontally disposed table. The dimensions thereof and the distance thereof from the lower end of the finished material shaft 15 are chosen so that the bulk material cone 21*a* of the finished material 21 coming out of the finished material shaft 15 opens on the surface of the table forming the baffle surface 20 inside the rims of the table.

A discharge device 22 is movable to and fro along the baffle surface 20 in the direction of the double arrow 23. The stroke speed and the stroke length of this discharge device 22, which is constructed as a beam, are variable.

The inlet opening of the finished material shaft 15 at the upper end of the shaft is covered by a classifier 24 which is constructed as a screen or grate.

The finished material 21 which is discharged by the discharge device 22 to both sides over the front and rear rim of the baffle surface 20 is transported further (conveying line 27) by an arrangement which is not shown. If required, a part of the material of the upper layer 11 can be admixed with the finished material (conveying line 28) after passing through the crusher 16.

Grate riddlings which fall down between the grate plates and the fixed and movable rows of plates 1, 2 are passed by a transport arrangement 29 either to the conveying line 27 of the finished material or to the conveying line 19 of the recirculated material.

The baffle wall 13 is disposed in the region between the first material feed zone (shaft 12) and the second material feed zone (shaft 14), and a distance a which corresponds to the height of the lower layer 10 is provided between the lower edge of the baffle wall and the cooling surface.

Figure 3:
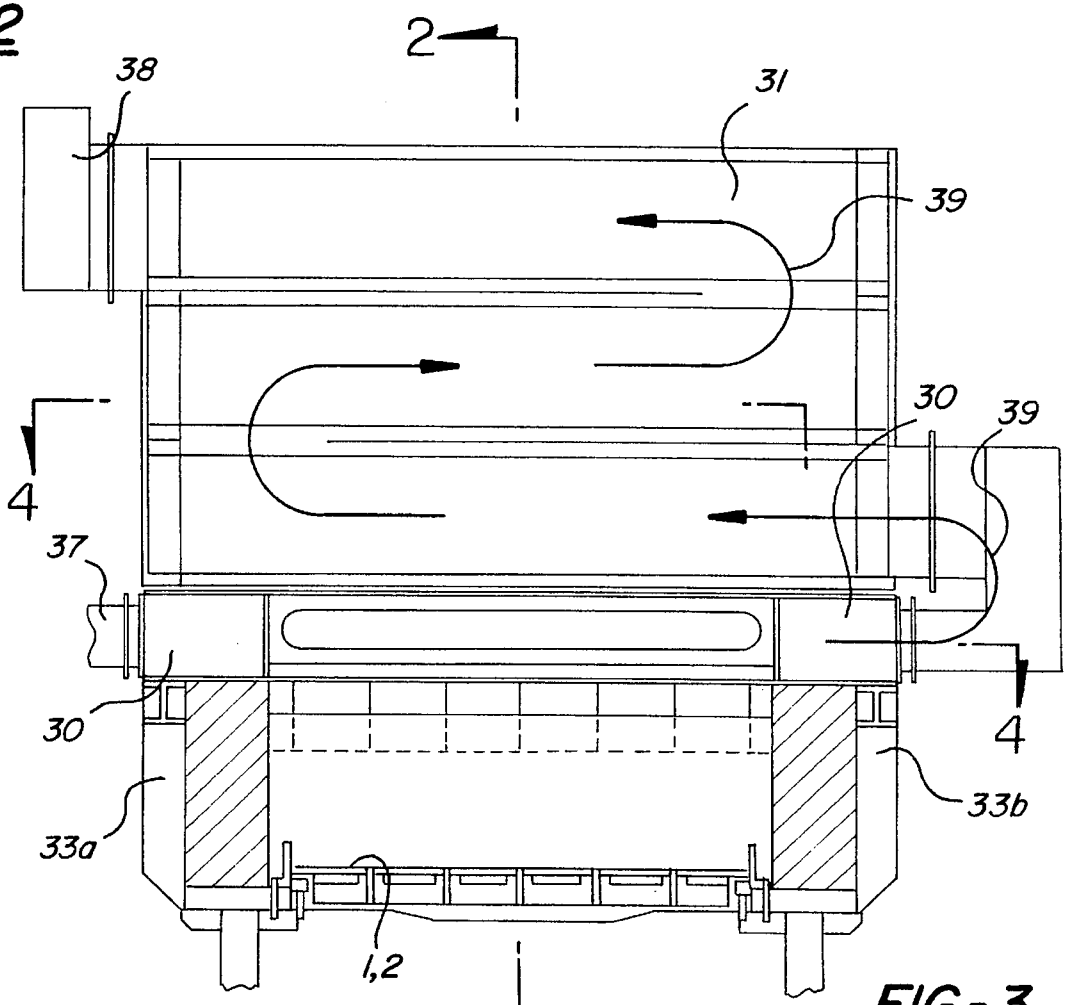
Figure 2:
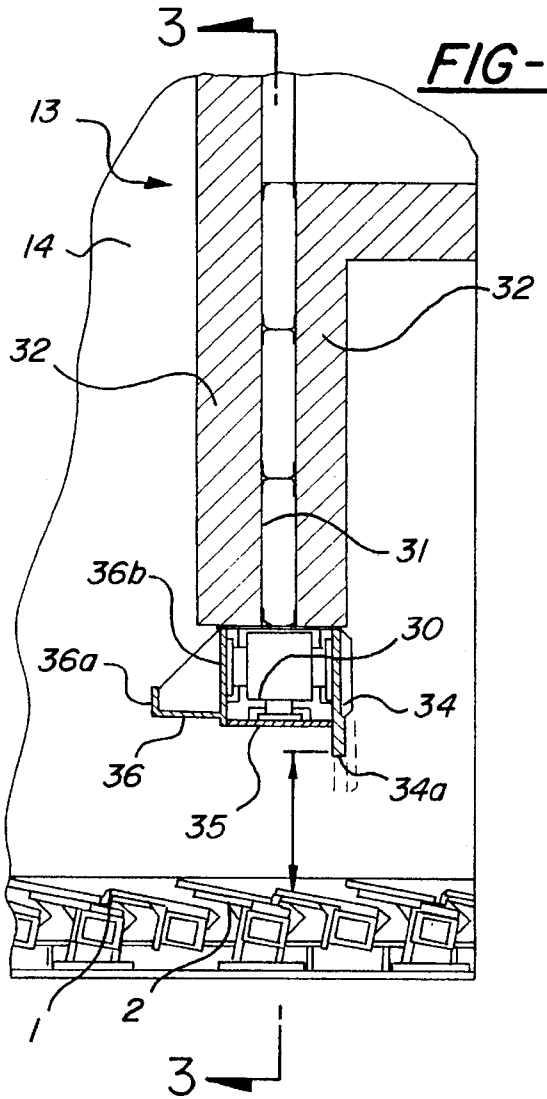
Figure 4:
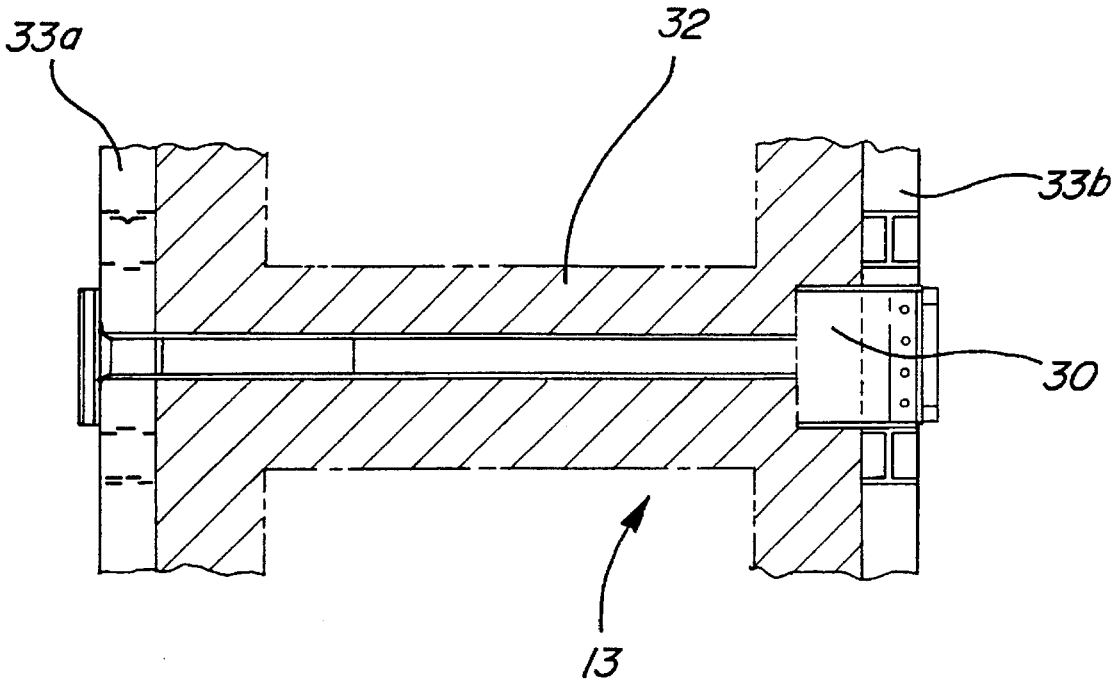

Before the baffle wall 13 is described in detail with the aid of FIGS. 2 to 4, the way in which the double layer cooler according to FIG. 1 operates should be explained.

The lower layer 10 of material for cooling which has already been precooled protects the grate surface of the cooler from an excessive thermal load as well as from severe wear by the hot material for cooling which forms the upper layer 11.

At the end of the cooler the two layers are separated by the separating arrangement formed by the resting material zone 18. An alteration in the thickness of the upper and lower layers is possible by adjustment of the vertical position of the separating arrangement. Thus for example the height of the resting material zone 18 can be increased by reducing the inclination of the chute 17 and vice versa). Naturally, within the scope of the invention other constructions are possible for separating the two layers. The classifier 24 provided at the upper end of the finished material shaft 15 holds back larger lumps of material which are present in the lower layer 10. These lumps of material are then either subjected to autogenous crushing in the material of the lower layer above the classifier 24, or they pass into the resting material zone 18 or into the upper layer 11. In the latter case they pass again through the crusher 16.

The finished material 21 is baffled on the baffle surface 20 since the bulk material cone 21*a* opens on the surface of the table forming the baffle surface 20 inside the rims of the table. Therefore independently of the particular grain size composition of the finished material 21—which may change during operation—the discharged quantity of material is determined exclusively by the stroke speed and the stroke length of the discharge device 22.

The invention was explained above using the example of a reciprocating grate cooler. However, naturally, it can also be used advantageously in other double layer coolers, particularly in double layer travelling-grate coolers.

The baffle wall according to the invention will be explained in detail below with the aid of the sectional representations according to FIGS. 2 to 4:

The baffle wall 13 consists essentially of a supporting element constructed as a supporting beam 30 and retaining elements which are disposed above it and are provided with a refractory lining 32 both on the side facing the shaft 12 and on the side facing the shaft 13. The supporting beam 30 extends over the entire width of the cooling surface and is retained in side walls 33*a* and 33*b* of the cooler.

The supporting beam 30 is provided with protective segments 34, 35 and 36 on the three side surfaces which come into contact with the material for cooling. The protective segment 34 facing the second material feed zone, i.e. the shaft 12, has a scraping edge 34*a* which determines the height of the lower layer 10. By contrast, the protective segment 36*a* facing the first material feed zone, i.e. the shaft 14, is constructed as a channel intended to receive material for cooling, the front boundary surface 36*a* of this channel being substantially lower than the rear boundary surface 36*b* connected to the supporting beam 30. The protective segments 34 and 35, by contrast, are essentially constructed towards the exterior as level plates.

The individual protective segments 34, 35, 36 are preferably produced from wear-resistant casting and are retained in a suitable manner on the supporting beam 30. They can example be retained in such a way that the protective segments made in one piece or consisting of a plurality of parts are pushed onto the supporting beam 30 in a dovetail guide.

So long as very hot material is to be cooled for example the clinker falling out of a rotary kiln, it is advantageous to cool the baffle wall 13, i.e, the supporting beam 30 and the retaining elements 31 with a suitable coolant, for example cooling air. As can be seen in particular from FIG. 3, cooling channels are provided for this purpose in the supporting beam 30 and in the retaining elements. Moreover, the supporting beam 30 has a cooling air inlet opening 37 and the uppermost retaining element 31 has a cooling air outlet opening 38. The cooling air is preferably guided is a meander shape (arrows 39) through the supporting beam and the retaining elements.

During operation the channel formed by the protective segment 36 becomes clogged with material falling through the shaft 14. In this case an oblique surface is formed which is inclined with respect to the cooling surface and on which further hot material to be cooled can land and slide down. In this way the friction occurs essentially within the material for cooling, so that the supporting beam 35 and also the protective segment 36 are protected against wear and excessive heat.

The individual protective segments are preferably replaceably mounted on the supporting beam so that in particular the protective segment 34 can be replaced with its scraping edge 34*a*. Therefore protective segments 34 can also be used in which the scraping edge 34*a* is a smaller distance from the cooling surface, as is indicated by broken lines in FIG. 2. In this way the height of the lower layer 10 can be adapted to the material to be cooled in order to achieve an optimum cooling effect. Thus fine-grained material requires a thinner lower layer 10 than coarse-grained material.

We claim:

1. Apparatus for cooling bulk material comprising: a movable conveyor having a material-supporting surface for transporting bulk material from an inlet end of said conveyor to an outlet end thereof; a first material inlet adjacent said inlet end of said conveyor for depositing relatively cool material on said surface of said conveyor to form a first layer of said relatively cool material on said surface; a second material inlet downstream of said first material inlet for depositing relatively hot material on said first layer to establish a second layer of such relatively hot material atop said first layer, said conveyor having cooling gas openings extending therethrough from beneath said conveyor; means for directing cooling gas upwardly through said openings and through said layers of material to cool said material; and baffle means between said first and second material inlets having a leveling edge spaced a predetermined distance above said surface for limiting the thickness of said first layer.

2. The apparatus of claim 1 including means for vertically adjusting said baffle means for varying said predetermined distance.

3. The apparatus of claim 1 wherein said baffle means includes a support beam adjacent said surface.

4. The apparatus of claim 3 including a heat-resistant shield covering said support beam and having outer surfaces for contacting said material.

5. The apparatus of claim 4 wherein said shield includes a scraping portion projecting toward said surface.

6. The apparatus of claim 4 wherein said shield includes a channel portion projecting into said first inlet means to receive and support a build up of said relatively cool material upstream of said baffle means.

7. The apparatus of claim 1 wherein said baffle means includes internal cooling channels communicating with a source of cooling fluid.

8. The apparatus of claim 1 wherein said surface comprises plates of a grate cooler conveyor.

9. The apparatus of claim 1 wherein said conveyor comprises a travelling grate cooler.

10. Apparatus for cooling bulk material comprising a movable conveyor having a material supporting surface for transporting bulk material from an inlet end thereof to an outlet end; baffle means supported above said conveyor and having a lower edge spaced a predetermined distance above said surface; means for depositing on said conveyor surface upstream of said baffle means a quantity of relatively cool bulk material having an average thickness greater than the distance of said lower edge of said baffle means above said conveyor surface, thereby enabling said baffle means to form a first layer of said material as said material passes said baffle means, said first layer having a thickness corresponding to said distance; means downstream of said baffle means for depositing on said first layer a quantity of relatively hot bulk material to form a second layer of said material atop said first layer, said conveyor having cooling gas openings therein; and means for directing cooling gas upwardly through said gas openings and through said layers of material to cool said material.

* * * * *